US005657617A

United States Patent [19]

Allen et al.

[11] Patent Number: 5,657,617

[45] Date of Patent: Aug. 19, 1997

[54] SHIPPING CASSETTE LID AND UNLID AUTOMATION

[75] Inventors: Ronald Allen; Michael Myslovaty, both of San Jose; Michael Edwin Slafter, Fremont, all of Calif.

[73] Assignee: Komag, Incorporated, Milpitas, Calif.

[21] Appl. No.: 591,853

[22] Filed: Jan. 25, 1996

[51] Int. Cl.[6] ..... B65B 7/28; B65B 69/00; B67B 3/22; B67B 7/16

[52] U.S. Cl. ..... 53/487; 53/492; 53/284; 53/290; 53/306; 53/381.4

[58] Field of Search ..... 53/471, 492, 290, 53/306, 332, 342, 360, 381.4, 487, 284

[56] References Cited

U.S. PATENT DOCUMENTS

| | | | |
|---|---|---|---|
| 2,717,730 | 9/1955 | Blann | 53/306 |
| 3,412,526 | 11/1968 | Bennert et al. | 53/290 X |
| 3,545,174 | 12/1970 | Randrup | 53/381.4 |
| 3,810,345 | 5/1974 | Lemmond et al. | 53/306 |
| 3,979,883 | 9/1976 | Patsaros | 53/306 |
| 4,014,723 | 3/1977 | Jones | 53/471 X |
| 4,122,649 | 10/1978 | Sawvel | 53/306 |
| 4,466,767 | 8/1984 | Meschi | 53/381.4 |
| 4,495,209 | 1/1985 | Whiteside | 53/471 X |
| 4,522,089 | 6/1985 | Alvi | 53/381.4 X |
| 4,557,382 | 12/1985 | Johnson | 206/444 |
| 5,005,275 | 4/1991 | Borst et al. | 53/290 X |

OTHER PUBLICATIONS

Videotape of Apparatus Submitted to Patent Office Jan. 25, 1995.

*Primary Examiner*—Horace M. Culver

*Attorney, Agent, or Firm*—Skjerven, Morrill, MacPherson, Franklin & Friel L.L.P.; Kenneth E. Leeds

[57] ABSTRACT

Apparatus for placing covers (5, 8) on a cassette (1) and taking covers (5, 8) off a cassette (1) comprises an upper cover removal structure (100U), a lower cover removal structure (100L), and means for holding the cassette in place (170–176). The upper cover removal structure (100U) includes a central body portion (102), a pair of arms (104, 106) rotatably mounted at the end of the central body portion, and fingers (112, 114) located at the end of the arms (104, 106). The fingers (112, 114) can be moved up and down in a direction parallel to the main axis of the arms. The upper cover removal structure (100U) includes means for moving the upper cover removal structure (100U) toward or away from the cassette (1). The lower cover removal structure (100L) includes a central body portion and a pair of arms 156, 158 having fingers (190, 192) at the ends thereof. The arms can move inwardly or outwardly to grasp the bottom cover (8). Also included are means (154) for moving the lower cover removal unit (100L) toward or away from the cassette. The apparatus is designed to minimize generation of particulate contamination. For example, during use, arms (104, 106) and fingers (112, 114) pull tongues (20) of top cover (5) outwardly so that catches (23) on tongues (20) do not snap over rims on the cassettes and generate particulate contamination.

20 Claims, 19 Drawing Sheets

SHIPPING CASSETTE LID AND UNLID AUTOMATION

BACKGROUND OF THE INVENTION

This invention relates to automation for placing covers on shipping cassettes and taking covers off shipping cassettes.

Magnetic disks are typically shipped in plastic cassettes, such as the cassettes described in U.S. Pat. No. 4,557,382, issued to Douglas M. Johnson on Dec. 10, 1985, and incorporated herein by reference. FIGS. 1A to 1D show a cassette 1 which includes slots 2 for receiving magnetic disks 3 (shown in FIG. 2).

Cassette 1 includes a top opening 4 for receiving a top cover 5 and a bottom opening 6 for receiving a bottom cover 8.

Bottom cover 8 includes a rim 10 which surrounds and mates with walls 12 at the bottom of cassette 1. Bottom cover 8 is held on cassette 1 by a friction fit. The top of cassette 1 includes a rim 27, which is received by a slot 28 in top cover 5.

As can be seen in FIG. 1B, the sides of cassette 1 include slots 16 surrounded by slot rims 18. The sides of top cover 5 include tongues 20 which cover slots 16 when top cover 5 is placed on cassette 1. A catch 23 (on each of the tongues 20) engages with one of rims 18 to hold top cover 5 in place. Each catch 23 includes a slanted bottom surface 24 (FIGS. 1C and 1D) such that if one pushes top cover 5 downward over rims 18, tongues 20 are pushed outwardly in the direction of arrows A until catches 23 pass rims 18. When catches 23 pass rims 18, tongues 20 snap back and catches 23 engage with rims 18. To remove top cover 5 from cassette 1, one must pull tongues 20 outwardly (again, in the direction of arrow A) prior to lifting top cover 5 from cassette 1.

Of importance, when top cover 5 and bottom cover 8 are placed on cassette 1, magnetic disks within the cassette are completely enclosed and protected from dust and other contaminants. Cassette 1 is typically used to transport the disks to different manufacturing stations during the disk manufacturing process (e.g. to stations where the disks are plated, textured, cleaned, sputtered or lubricated) and to ship disks to customers. It is desirable to automate as much of the manufacturing process as possible, and it is known in the art to provide automation which removes top cover 5 and bottom cover 8 from cassette 1 during various manufacturing steps, and then places the top and bottom covers back on the cassette.

Many of the manufacturing steps during magnetic disk manufacturing require extremely clean environments, e.g. a "class 10" manufacturing environment. (Class 10 is a manufacturing standard established by the International Standards Organization, or ISO.) We have discovered that if the machinery used to place top cover 5 onto cassette 1 simply pushes top cover 5 downward so that catches 23 are pushed outward and then snap back over rims 18, contamination particles can be generated when catches 23 snap back over rims 18. These contamination particles can cause problems during disk manufacturing and use, and negatively impact yields.

SUMMARY OF THE INVENTION

It is an object of the invention to reduce the amount of human interaction during disk manufacturing.

It is another object of the invention to reduce particle contamination, yield loss and damage during disk manufacturing.

It is another object of the invention to facilitate automation at various points during the disk manufacturing process.

It is another object of the invention to provide improved automation for removing covers from cassettes and placing covers back onto the cassettes during manufacturing.

It is another object of the invention to provide improved automation for placing covers onto cassettes in a manner which minimizes particle generation.

Apparatus in accordance with our invention includes a modular structure for removing top and bottom covers from and placing top and bottom covers on a cassette. The cassette typically contains magnetic disks, although our invention can be used in conjunction with cassettes that carry other products, e.g. semiconductor wafers, magneto-optic disks, etc.

Of importance, the module includes upper and lower structures, each of which comprises a pair of arms, each arm comprising one or more fingers. The upper structure removes top covers from and places top covers onto cassettes. Similarly, the lower structure removes bottom covers from and places bottom covers onto cassettes.

Initially, during use, the cassette is brought into a station within the apparatus and a set of clamping fingers clamp the cassette in place. Also, initially, the arms of the upper and lower structures are extended outward. The upper structure is pushed downward onto the top cover, and then the lower structure is pushed upward against the bottom cover. The lower structure arms are then brought inward so that the fingers of the lower structure arms engage with the bottom cover. The lower structure is then brought downward, and the bottom cover is carried downward by the lower structure, and is thereby removed from the cassette.

The arms of the upper structure are then brought inward, and the fingers of the arms of the upper structure are pushed upward so that the fingers engage with the tongues of the top cassette cover. The arms then swing outwardly so that the fingers pull the tongues outwardly. The upper structure is then moved upwardly, thereby taking the top cover off the cassette. The clamping fingers then release the cassette, and the cassette is moved to another station where manufacturing steps can be performed on the disks contained therein.

The apparatus in accordance with our invention also places the covers back on the cassette. This is typically accomplished by placing the cassette within the apparatus, holding the cassette in place with the clamping fingers, bringing the upper structure downward (with the arms still extending outward), thereafter bringing the upper structure arms inward, bringing the fingers downward so that they no longer engage with the tongues of the top cover, and bringing the arms outward. It is noted that by using these steps to place the top cover on the cassette, there is no snapping of the catches over the rims as described above. This is important in order to avoid generating dust and other contaminants known in the art as particulates.

After the arms of the upper structure are extended outward, the lower structure moves upward to place the bottom cover onto the cassette. The arms of the lower structure are then moved outward so that the fingers of the lower structure no longer engage with the bottom cover. The lower structure then moves downward, the upper structure then moves upward, and the cassette is unclamped and removed from the apparatus.

DETAILED DESCRIPTION

Figure 2:
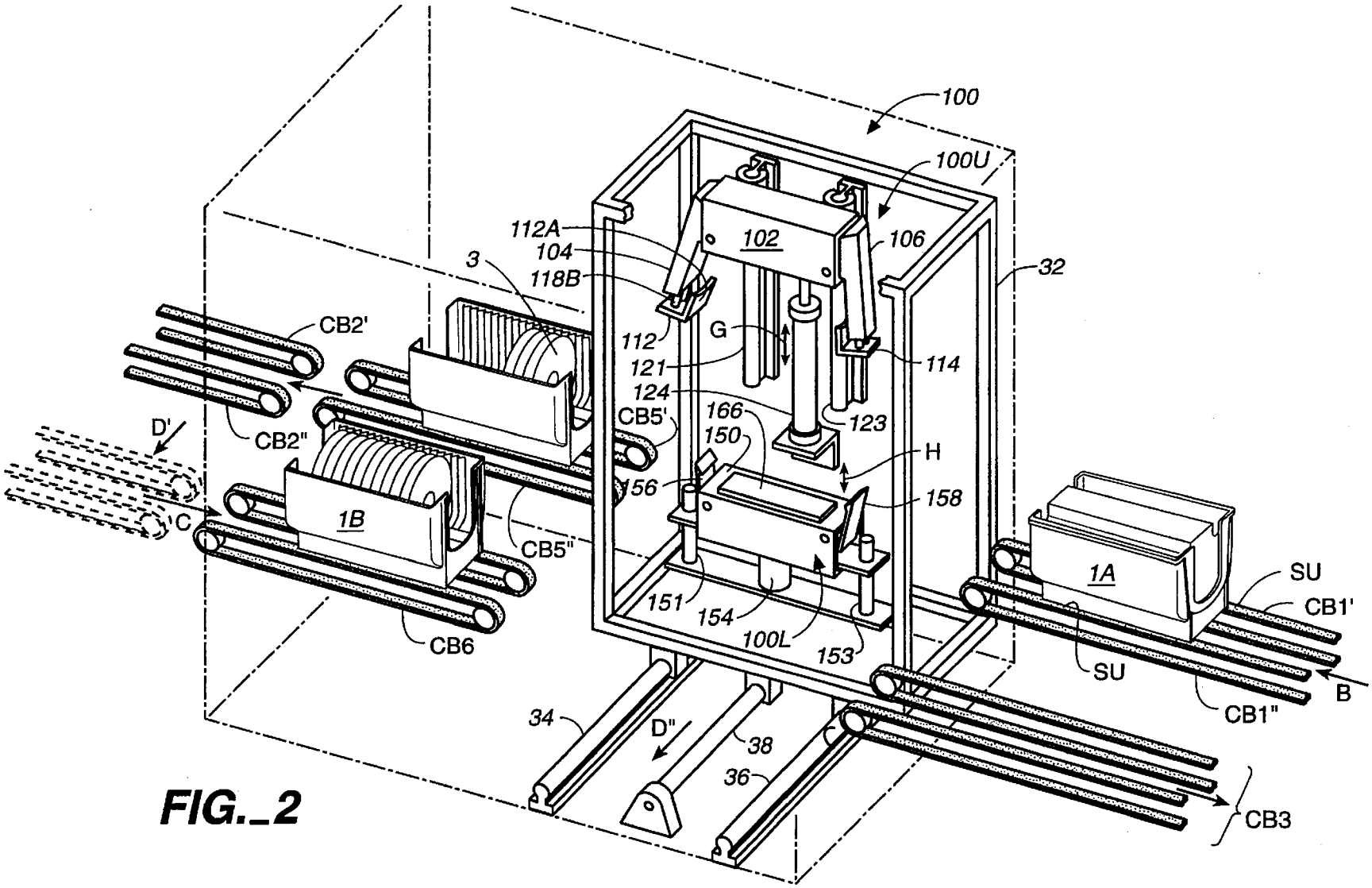
FIG. 2 shows apparatus for removing bottom and top covers from a cassette.

FIG. 2 illustrates a set of conveyer bands CB1', CB1" for transporting cassettes such as cassette 1A in a direction B to apparatus 100 where top and bottom covers are removed therefrom, and sets of conveyer bands CB5', CB5" and CB2', CB2" for moving the cassettes from apparatus 100 to a location (not shown) where disks can be removed from the cassettes for processing. This processing can involve any one of a number of manufacturing steps, e.g. depositing additional layers onto the disks by electroless plating, texturing or polishing the disks, sputtering layers onto the disks, applying lubrication to the disks, etc. The precise manufacturing operation performed on the disks is not critical to our invention.

Bands CB1' and CB1" are hereinafter collectively referred to as bands CB1. Bands CB1 are moved in direction B by a motor (not shown).

After the above-mentioned manufacturing process is performed, conveyer bands CB2', CB2" (collectively referred to as bands CB2) are moved in a direction D' to align bands CB2 with bands CB6 (e.g. as shown in phantom in FIG. 2). This can be accomplished with a worm drive coupled to a motor or an air cylinder (not shown).

Thereafter, bands CB2 convey the cassettes back in a direction C to apparatus 100 (via bands CB6) so that covers can be placed back on the cassettes. Conveyer bands CB3 then convey cassettes away from apparatus 100. Apparatus 100 is constructed as a module within a frame 32. Frame 32 is mounted so that it can be moved inwardly and outwardly in the direction of arrow D" (parallel to arrow D') along rails 34, 36 by an air cylinder 38 of a type known as a magnetically coupled rodless cylinder. Apparatus 100, which comprises an upper cover removal structure 100U and a lower cover removal structure 100L, is described in greater detail below.

Figure 3:
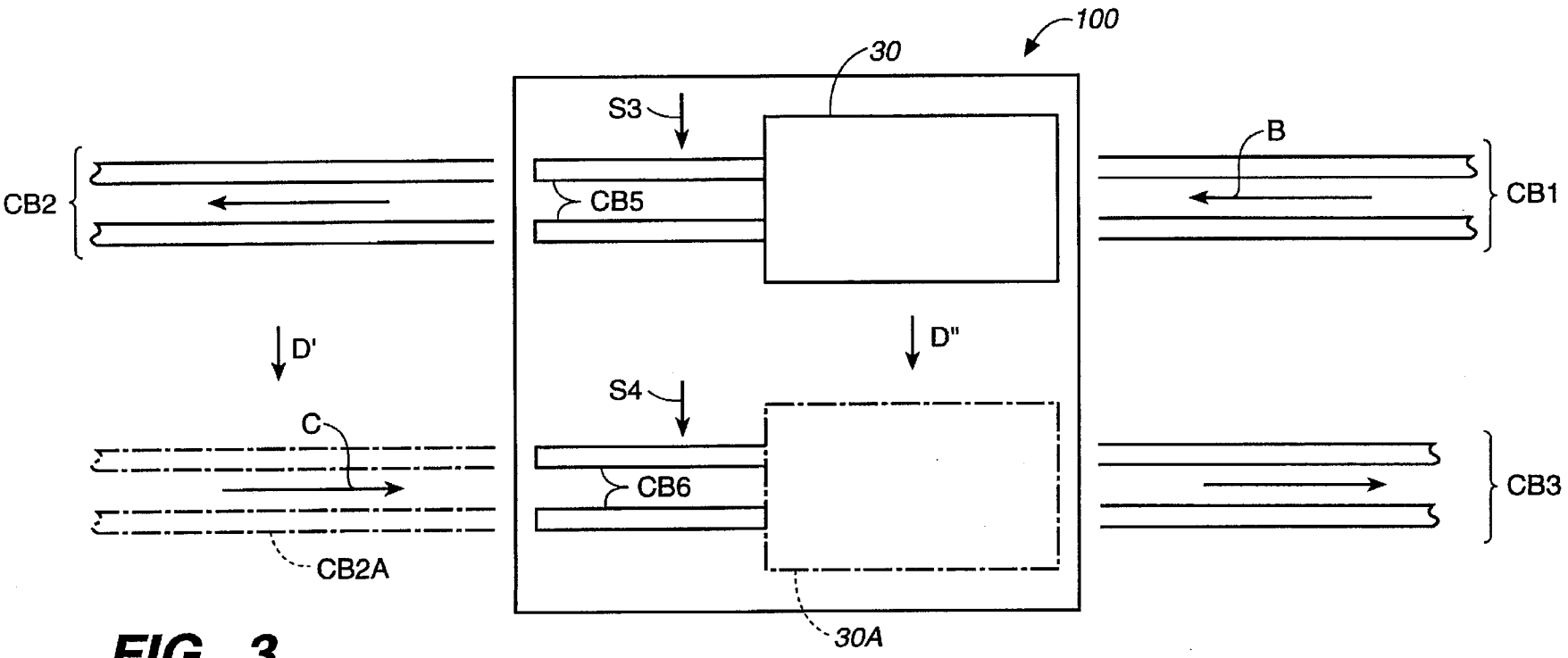
FIG. 3 is a schematic plan view of the station within the apparatus of FIG. 2 where covers are removed from and placed on the cassette.

During use, first cassette 1A is conveyed by conveyer bands CB1 to a station 30 within apparatus 100 (see FIG. 3). Station 30 is positioned by air cylinder 38 so that it is in a position to receive cassette 1A from conveyer bands CB1. Upper cover removal structure 100U moves down to remove top cover 5 from the cassette and lower cover removal structure 100L moves up to remove bottom cover 8 from the cassette. The cassette, having covers removed therefrom, is then transported via bands CB5 (FIGS. 2 and 3) and CB2 to a location where further manufacturing steps can be performed on the disks contained therein. After the above-mentioned manufacturing steps, bands CB2 are moved in direction D' to the location in FIGS. 2 and 3 shown in phantom.

Station 30 is then moved in direction D" by air cylinder 38 to a location where it can receive the cassette back from conveyer bands CB2 via conveyer bands CB6. When this cassette reaches station 30, top and bottom covers 5, 8 (previously taken from the cassette 1A) are placed back onto the cassette, and the cassette is then transported away from station 30 by conveyer bands CB3.

Bands CB5, CB6 are included in apparatus 100 to serve as holding areas. For example, if a cassette reaches conveyer bands CB6 while station 30 is in the location illustrated in FIG. 3, bands CB6 are stopped, and hold that cassette until station 30 reaches location 30A shown in phantom in FIG. 3. Similarly, if apparatus 100 has finished removing covers from a cassette while bands CB2 are in location CB2A shown in phantom, that cassette remains on bands CB5 until bands CB2 are in position to receive the cassette from bands CB5. Thus, apparatus 100 does not have to wait until bands CB2 are ready to receive a cassette, and bands CB2 do not have to wait until apparatus 100 is ready to receive a cassette.

Upper Cover Removal Structure

Figure 4A:
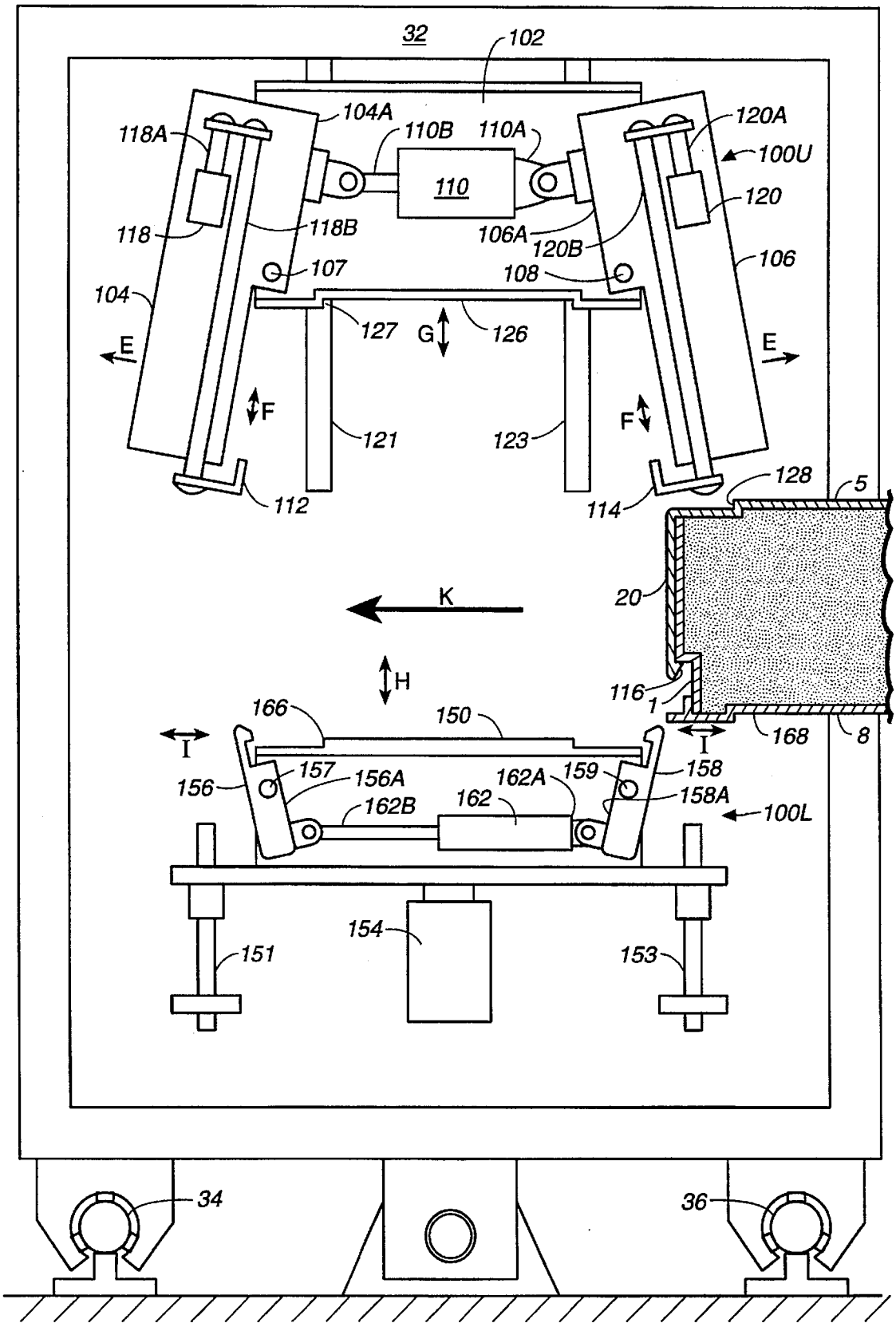
FIGS. 4A to 4L illustrate the apparatus of FIG. 2 during use.
Figure 4B:
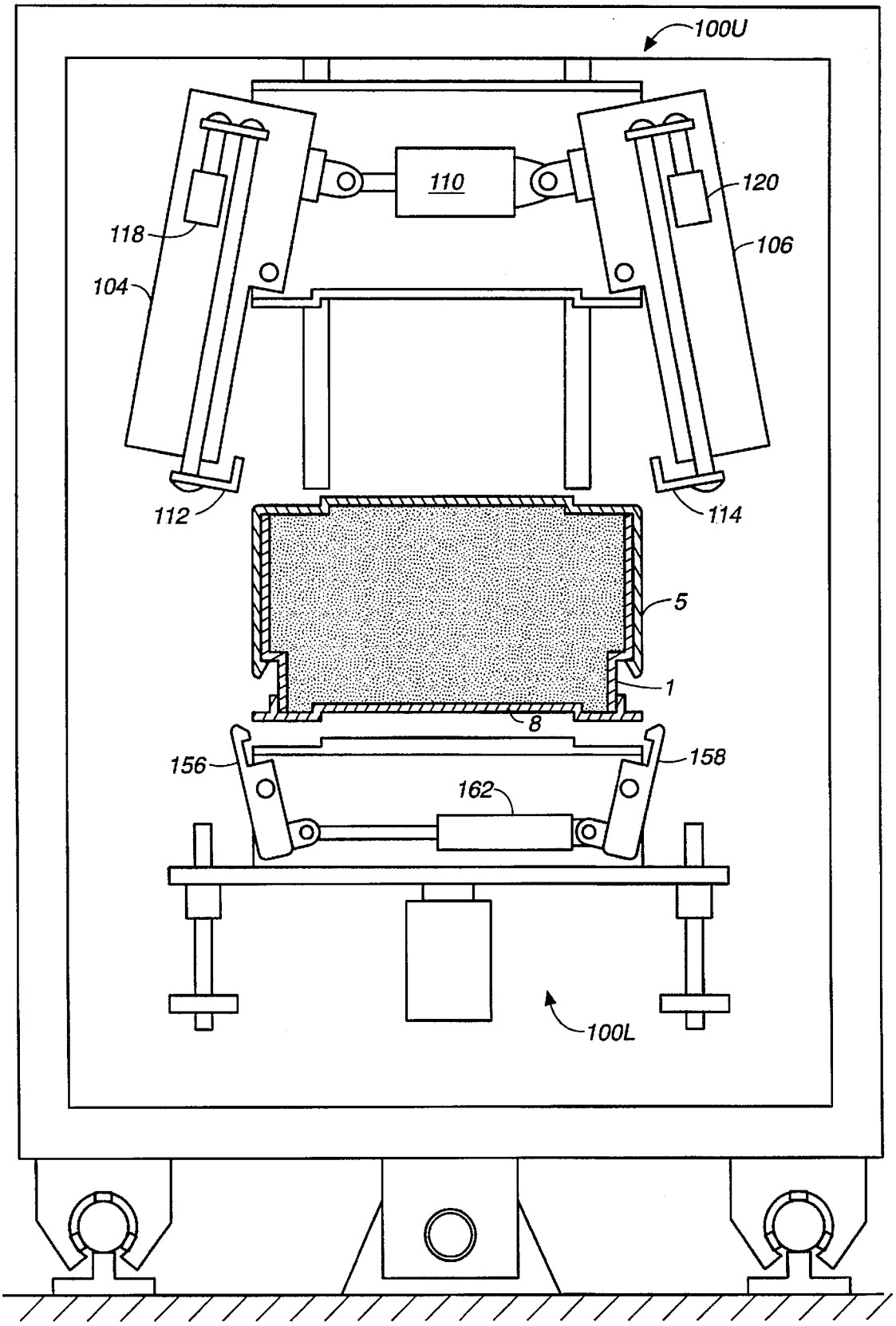

Structure 100U includes a central member 102 and two arms 104, 106 coupled to central member 102 such that arms 104, 106 can rotate outwardly about pivot axes 107, 108 (i.e. in the direction of arrows E as shown in FIG. 4A) when moved by an air cylinder 110. One end 110A of air cylinder 110 is mounted to a wall 106A of arm 106, while the piston rod 110B of air cylinder 110 is mounted to a wall 104A of arm 104. (Air cylinder 110 is not otherwise affixed to central member 102.) Of importance, walls 104A, 106A of arms 104, 106 serve as side walls of central member 102. Placing air cylinder 110 within central member 102 helps prevent dust or contaminants from the air cylinder from escaping and interfering with manufacturing operations. As described below, other air cylinders used with apparatus 100 are likewise placed in enclosures to prevent contamination.

Coupled to arms 104, 106 are a set of fingers 112, 114, for engaging with rims 116 of tongues 20 of top cover 5. Fingers 112 and 114 are movable in an upward or downward direction (i.e. in the direction of arrow F) by air cylinders 118, 120, respectively. Air cylinders 118 and 120 are not shown in FIG. 2, but are shown in FIGS. 4A to 4L. Air cylinders 118 and 120 are mounted by brackets on one of the inside walls of arms 104 and 106, respectively. As can be seen, air cylinders 118, 120 are coupled to fingers 112, 114 via piston rods 118A, 120A and rods 118B, 120B, respectively. Although only one rod 118B is shown coupled to finger 112, in one embodiment, a pair of rods 118B', 118B" are used to move finger 112, e.g. as shown in FIG. 5. Finger 114 can be similarly attached to two rods.

Central member 102 can be moved up or down (see arrow G) along rails 121, 123 by an air cylinder 124 (FIG. 2). (As seen in FIG. 5, air cylinder 124 is coupled to central member 102 via a piston rod 124A and clevis 125.)

As can be seen in FIG. 4A, a lower surface 126 of central member 102 includes an indentation 127 which mates with a projection 128 of top cover 5 to better secure cover 5 to structure 100U after cover 5 has been removed from cassette 1.

Lower Cover Removal Structure

Lower cover removal structure 100L can be moved up or down (see arrow H) along rails 151, 153 by an air cylinder 154 (FIGS. 4A to 4L). A pair of arms 156, 158 are coupled to structure 100L such that arms 156 and 158 can rotate about pivot axes 157, 159, and are moved outwardly or inwardly (see arrows I) by an air cylinder 162 to either grasp or release bottom cover 8. One end 162A of air cylinder 162 is mounted to a wall 158A of arm 158, while piston rod 162B of air cylinder 162 is coupled to a wall 156A of arm 156. (Air cylinder 162 is not otherwise affixed to structure 100L.)

Structure 100L includes a platform 150 which includes a projection 166. Of importance, projection 166 mates with an indentation 168 in bottom cover 8 to better secure cover 8 to structure 100L.

As mentioned above, central member 102 is essentially a metal box in which walls 104A, 106A of arms 104, 106 serve as side walls of central member 102. Air cylinder 110 is mounted to walls 104A, 106A as described above. Thus, central member 102 has a very simple and inexpensive design. Similarly, arms 156 and 158 serve as part of the side walls of structure 100L, which also has a simple and inexpensive design.

Apparatus 100 includes four movable projections or fingers 170, 172, 174 and 176 (FIG. 6) which are moved inwardly or outwardly (see arrows J) by associated rotary air cylinders 178, 180, 182, 184 in order to grasp and position cassette 1 while top and bottom covers 5, 8 are placed on or removed from cassette 1. (Fingers 170 to 176 are not part of structures 100U or 100L, and do not move up or down.)

Figure 1A:
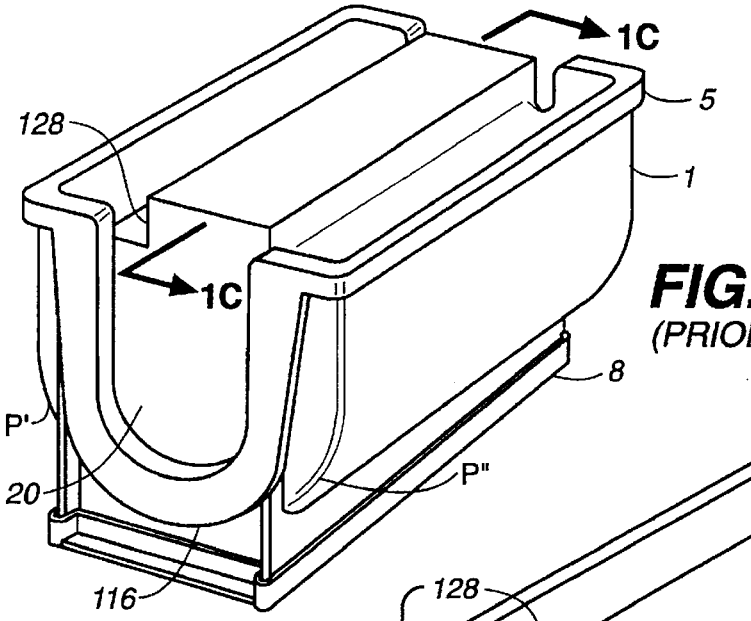
FIG. 1A (PRIOR ART)
FIG. 1A shows a cassette with top and bottom covers installed thereon.
Figure 1B:
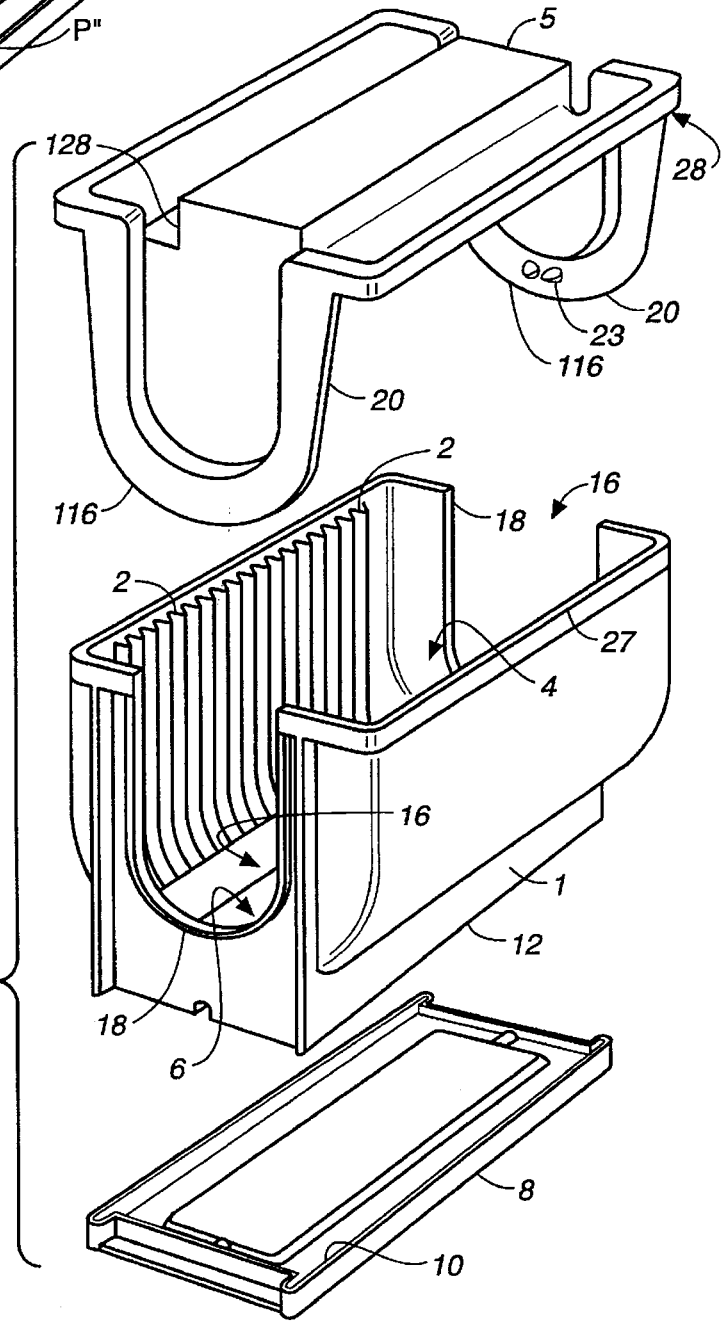
FIG. 1B (PRIOR ART)
FIG. 1B is an exploded view showing top cover, cassette and bottom cover.
Figure 1C:
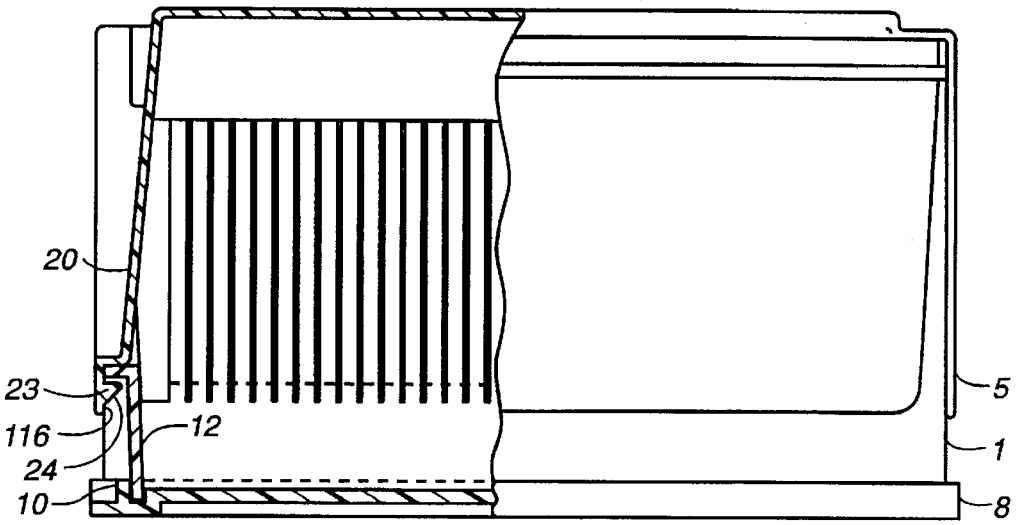
FIG. 1C (PRIOR ART)
FIG. 1C is an enlarged cross-section taken along line 1C—1C of FIG. 1A.
Figure 1D:
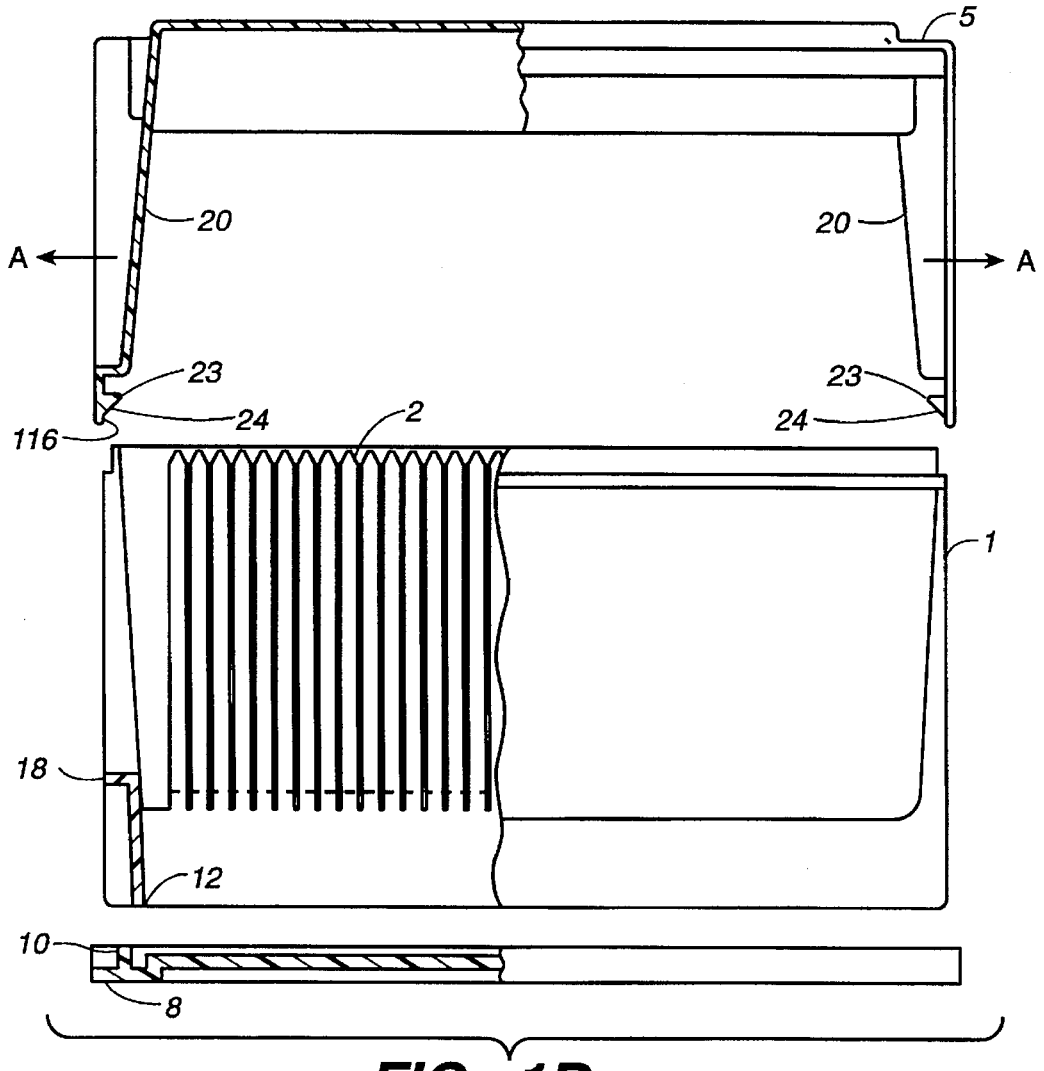
FIG. 1D (PRIOR ART)
FIG. 1D is an exploded cross section view showing the top cover, cassette and bottom cover.

Apparatus 100 also includes bands CB7', CB7" (shown in FIG. 6 and collectively referred to as bands CB7) for moving cassette 1 in direction K or L. Bands CB7 are driven by a stepper motor 185 (FIG. 5) and pulley structure 187. Bands CB7 grasp cassette 1A at points P', P" (FIG. 1A) where the cassette flares outwardly. (Bands CB7 thus support cassette 1A in a manner different from the other bands shown in FIG. 2. Specifically, the bottom of cassette 1A simply sits on the top, planar surfaces SU of bands CB1. Cassette 1A is subsequently supported by bands CB2 to CB6 in the same manner as bands CB1.)

In one embodiment of the invention, the air cylinders are commercially available air cylinders as set forth below in table I. The air cylinders are coupled to sources of air pressure via solenoid actuators such as device model number HO-040A, manufactured by Humphrey Products Co. of Kalamazoo, Mich. The air cylinders typically have a vacuum exhaust which is useful for clean room operations. Specifically, by providing such a vacuum exhaust, any dust or particles which might otherwise be generated by the air cylinders are carried away so that they cannot interfere with manufacturing operations. The solenoid actuators are controlled by a programmable logic controller ("PLC") integrated circuit such as device number RX80, manufactured by Mitsubishi. (Other appropriate integrated circuits could be used in lieu of an RX80.) Conveyor bands CB1, CB2 and CB3 can be of a type available from Phase 2 Automation of Fremont, Calif.

TABLE I

| Reference Number | Model Number | Manufacturer |
|---|---|---|
| 38 | CUL-00343-A-10.5 | Bimba Mfr. Co., Monee, Illinois |
| 110 | QM95-35834 | Compact Air Products Co., Inc., Westminster, S.C. |

TABLE I-continued

| Reference Number | Model Number | Manufacturer |
|---|---|---|
| 118, 120 | CS-PDA-S-16x15-A-2C153-A-2 | Koganey Corp., Tokyo, Japan |
| 154 | 11-CDQ2B20-20D-A73 | SMC Pneumatics, Inc. of Indianapolis, Indiana |
| 162 | CS-PDA-S16x15-M-2C153-A-2 | Koganey Corp., Tokyo, Japan |
| 170–176, 192 and 213 | 10-CDRB1BW20-180S-S79 | SMC Pneumatics, Inc. of Indianapolis, Indiana |

Rails 121, 123, 151 and 153 are mounted in a fixed position within frame 32, which in turn rides on rails 34, 36. As mentioned above, module frame 32 is pushed along rails 34, 36 by air cylinder 38. (Air cylinder 38 is coupled to a solenoid which is also controlled by the PLC integrated circuit.) Thus, both upper and lower units 100U and 100L move together as a single module in the direction of rails 34, 36.

Figure 5:
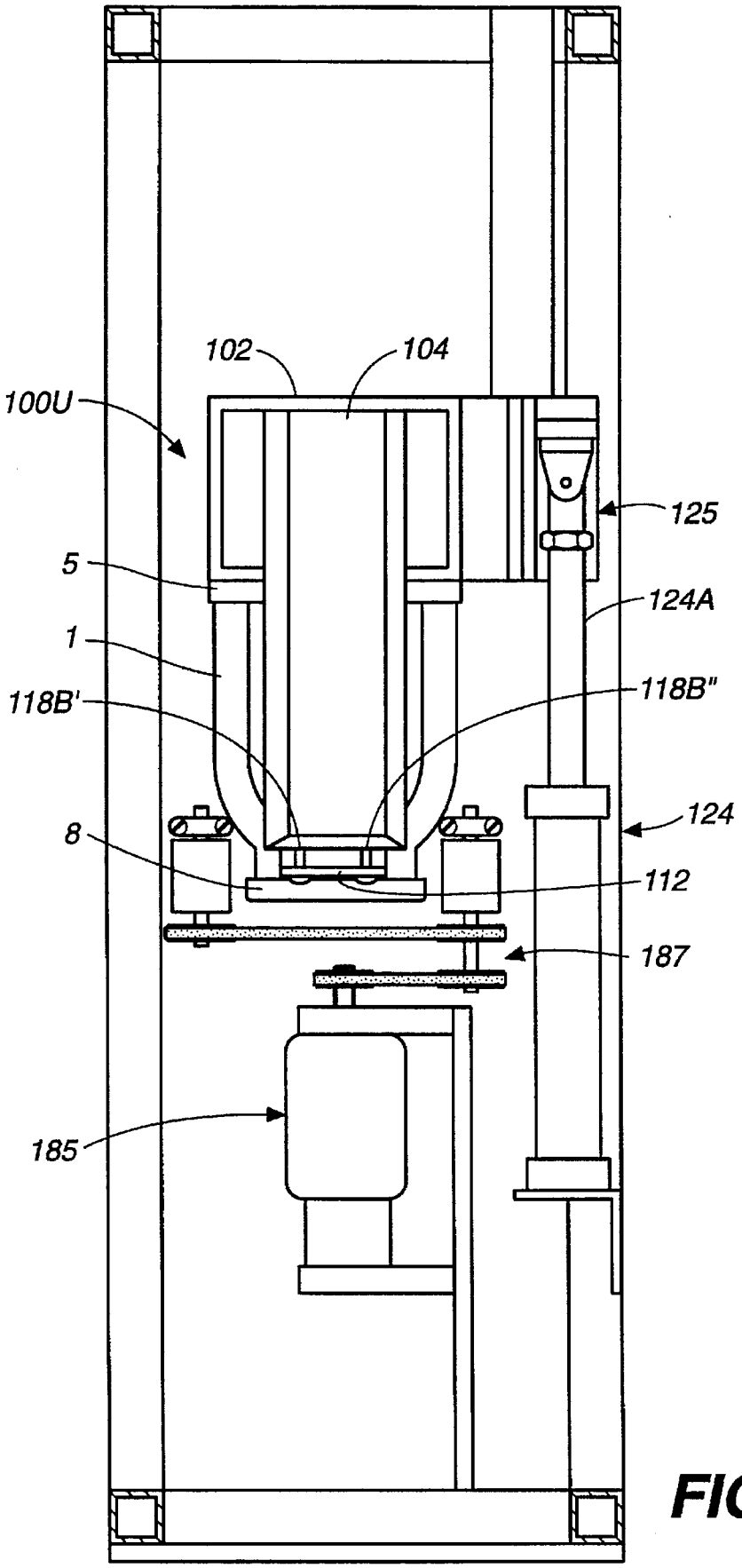
FIG. 5 is a side view showing some of the structures within the apparatus of FIG. 2, including the upper cover removal structure and a motor for driving conveyer bands.
Figure 6:
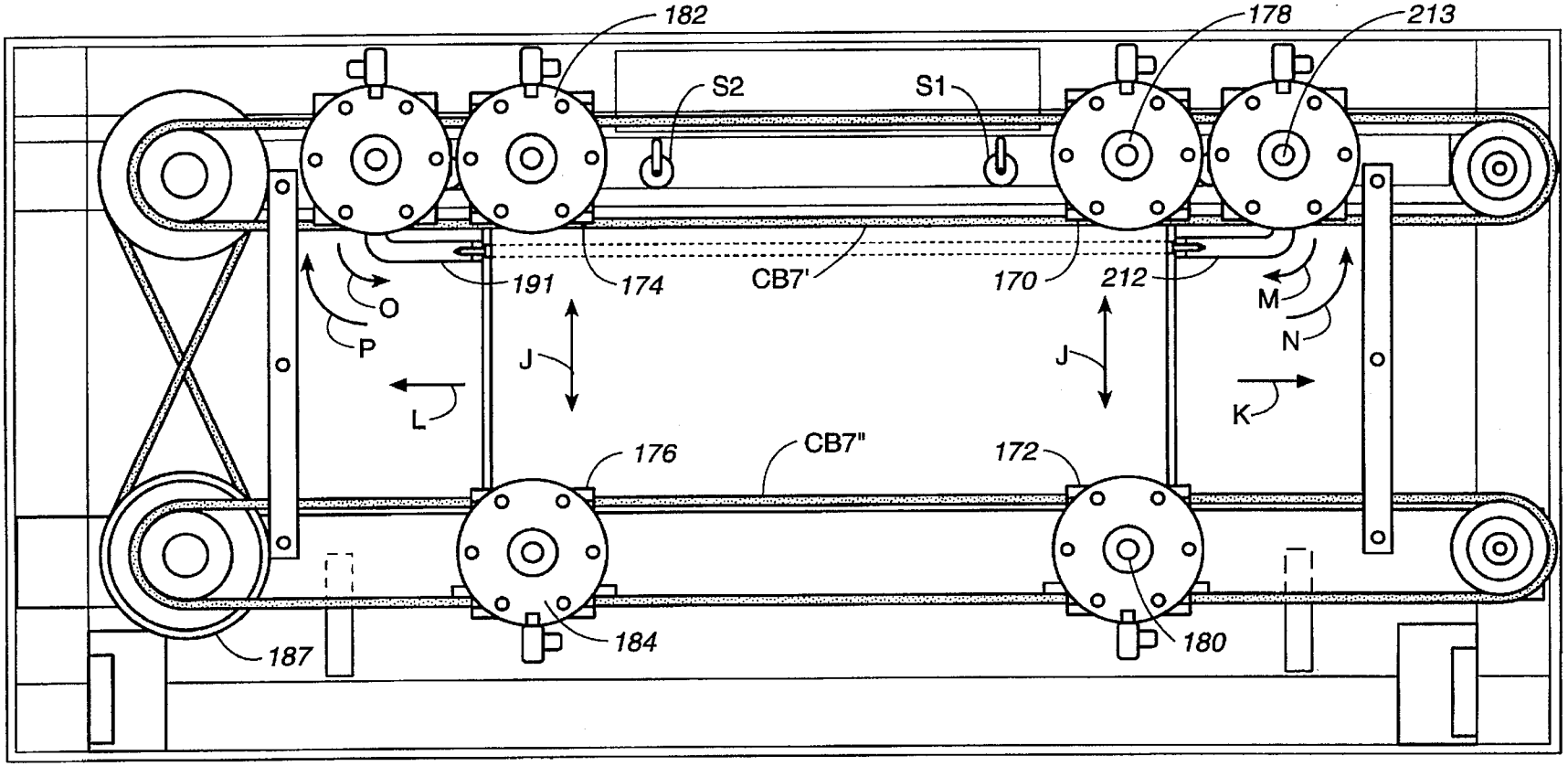
FIG. 6 is a plan view of the station within the apparatus of FIG. 2 where covers are taken off and placed on the cassette.

FIGS. 4A to 4L illustrate apparatus 100 during use. Referring to FIGS. 6 and 4A, a mechanical stop 212 swings into place in a direction M to serve as a stop for cassette 1A. (Mechanical stop 212 is actuated by an air cylinder 213. Air cylinder 213 is actuated by a solenoid which is also controlled by the PLC integrated circuit.) Cassette 1A is moved in direction K into a region between upper and lower structures 100U, 100L by conveyer bands CB1 (FIG. 2), and then by conveyer bands CB7 (FIG. 6) which engage and pull cassette 1A when cassette 1A reaches the end of conveyer bands CB1. A sensor S1 (FIG. 6) senses when cassette 1A is a short distance from stop 212, and in response thereto, the PLC integrated circuit slows the stepper motor driving bands CB7. As cassette 1A moves closer to stop 212, cassette 1A is sensed by a second sensor (not shown), and in response thereto, bands CB7 push cassette 1A into mechanical stop 212 and then stop. (The stepper motor actually over-drives bands CB7 by a short distance to ensure that cassette 1A is in position against stop 212.) As mentioned above, bands CB7 are driven by motor 185 (FIG. 5) which in turn is controlled by the PLC integrated circuit.

Thereafter, fingers 170–176 are pushed against cassette 1A to grasp and hold cassette 1A in place (in the position shown in FIG. 4B), and stop 212 is moved away (in direction N). At this time, upper structure 100U is in its upper position, lower structure 100L is in the lower position, arms 104, 106, 156 and 158 are outward, and fingers 112, 114 are in their upper position (see FIG. 4B).

Figure 4C:
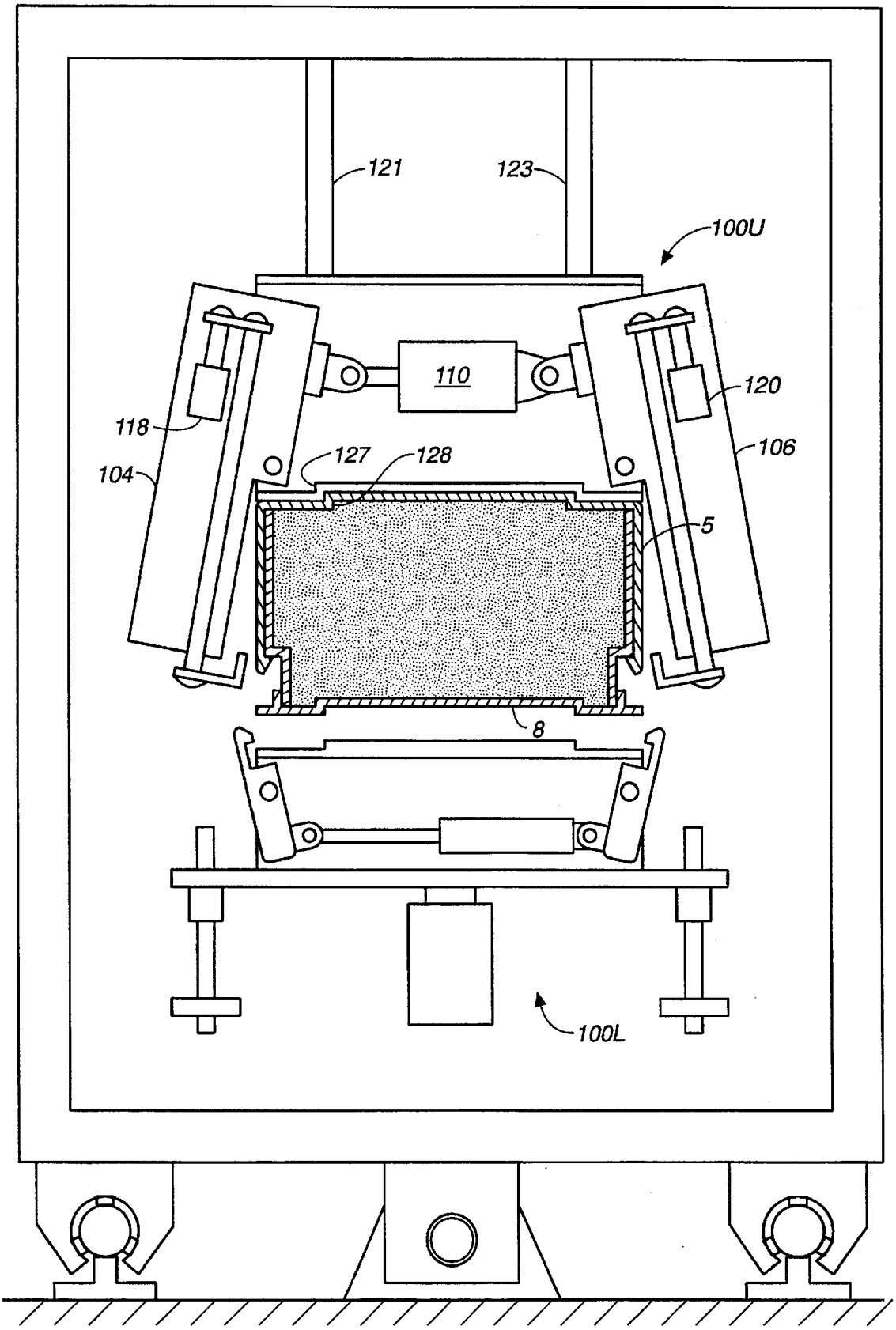

Referring to FIG. 4C, upper structure 100U is moved downward along rails 121, 123 by air cylinder 124 (shown in FIGS. 2 and 5) until indentation 127 mates with projection 128 of top cover 5. Arms 104, 106 are held in an outward position by air cylinder 110 while structure 100U is moving downward.

Figure 4D:
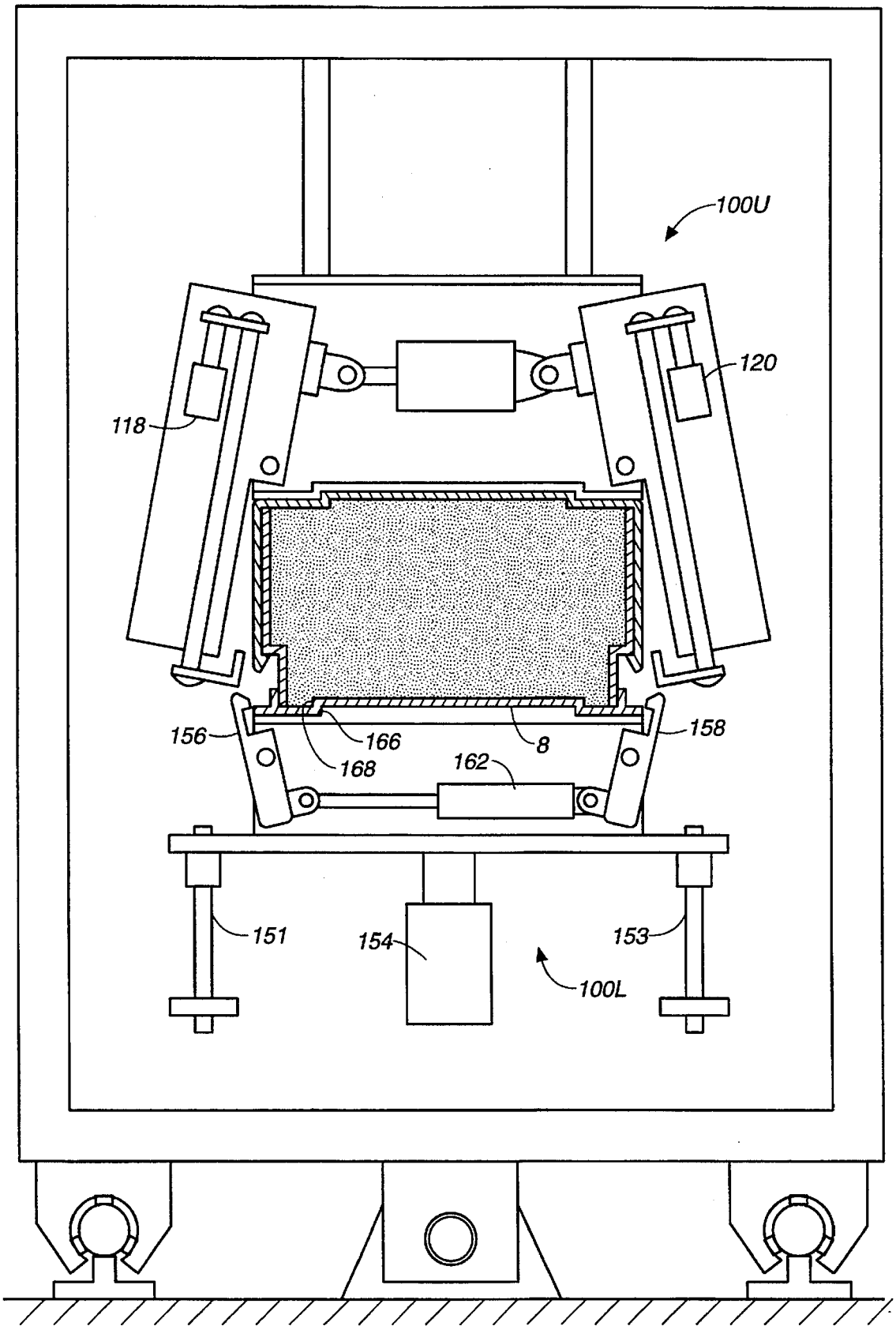

Referring to FIG. 4D, lower structure 100L is moved upward along rails 151, 153 by air cylinder 154 until projection 166 mates with indentation 168 of bottom cover 8. Of importance, arms 156, 158 are held outward by air cylinder 162 while lower structure 100L moves upward.

Figure 4E:
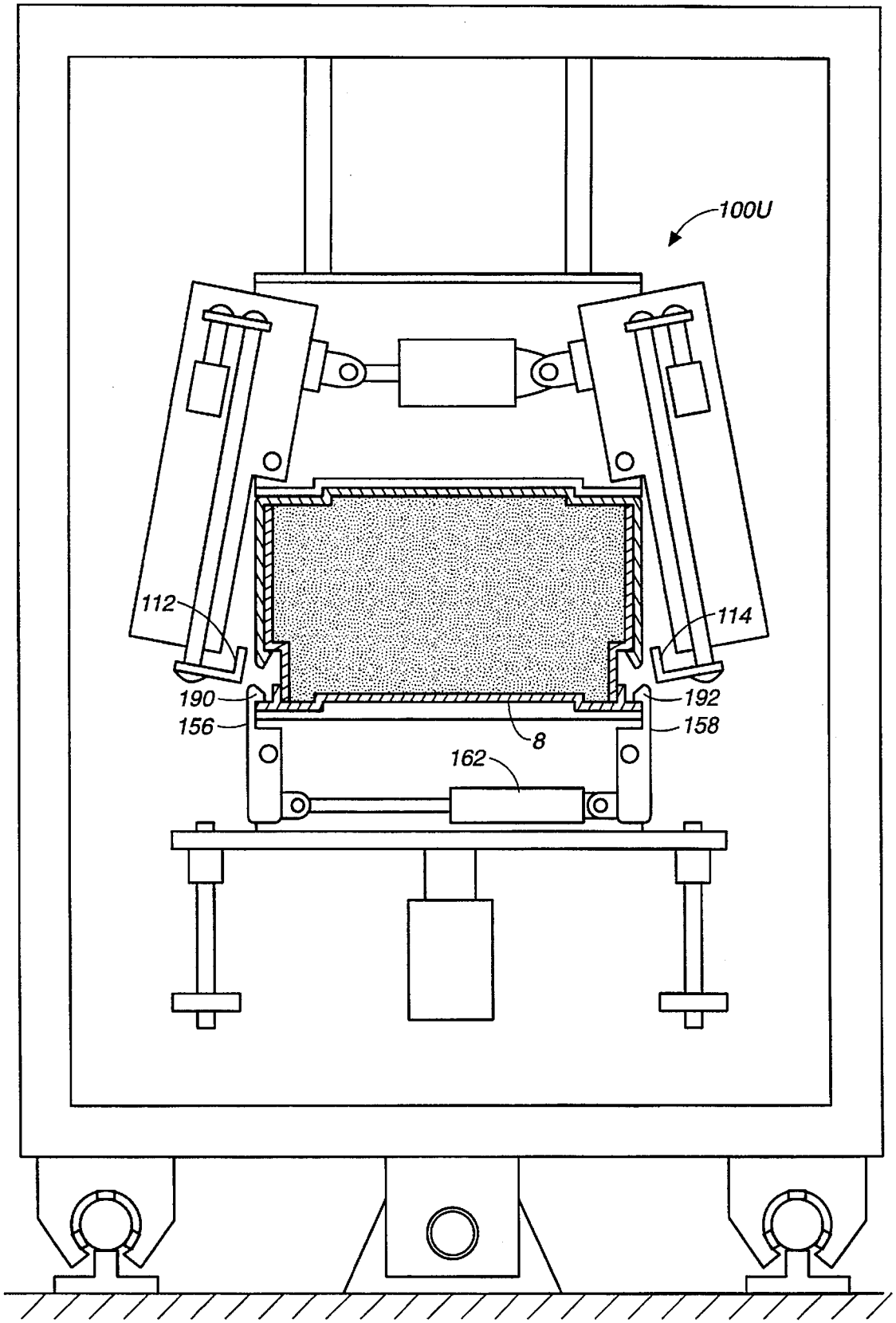

Referring to FIG. 4E, arms 156, 158 are then moved inward by air cylinder 162 so that fingers 190, 192 (affixed to the ends of arms 156, 158) may grasp bottom cover 8. (Unlike fingers 112, 114 of upper structure 100U, fingers 190 and 192 are fixed with respect to arms 156, 158, and cannot be moved independently of arms 156, 158.)

Figure 4F:
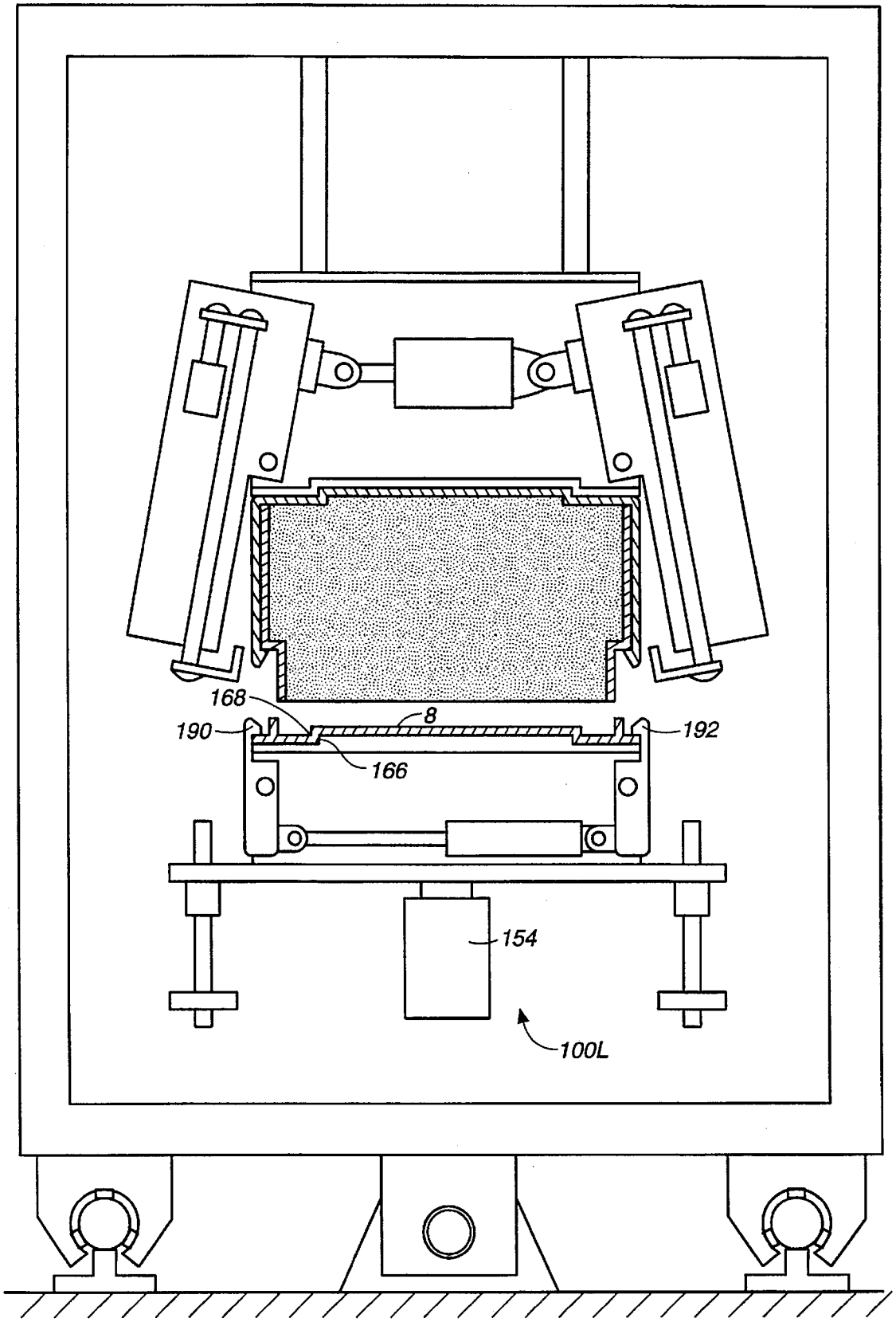

Referring to FIG. 4F, lower structure 100L is then moved downward by air cylinder 154. Of importance, bottom cover 8 is held in place by fingers 190, 192. Projection 166 remains mated with indentation 168 to further ensure that bottom cover 8 is held securely to structure 100L.

Figure 4G:
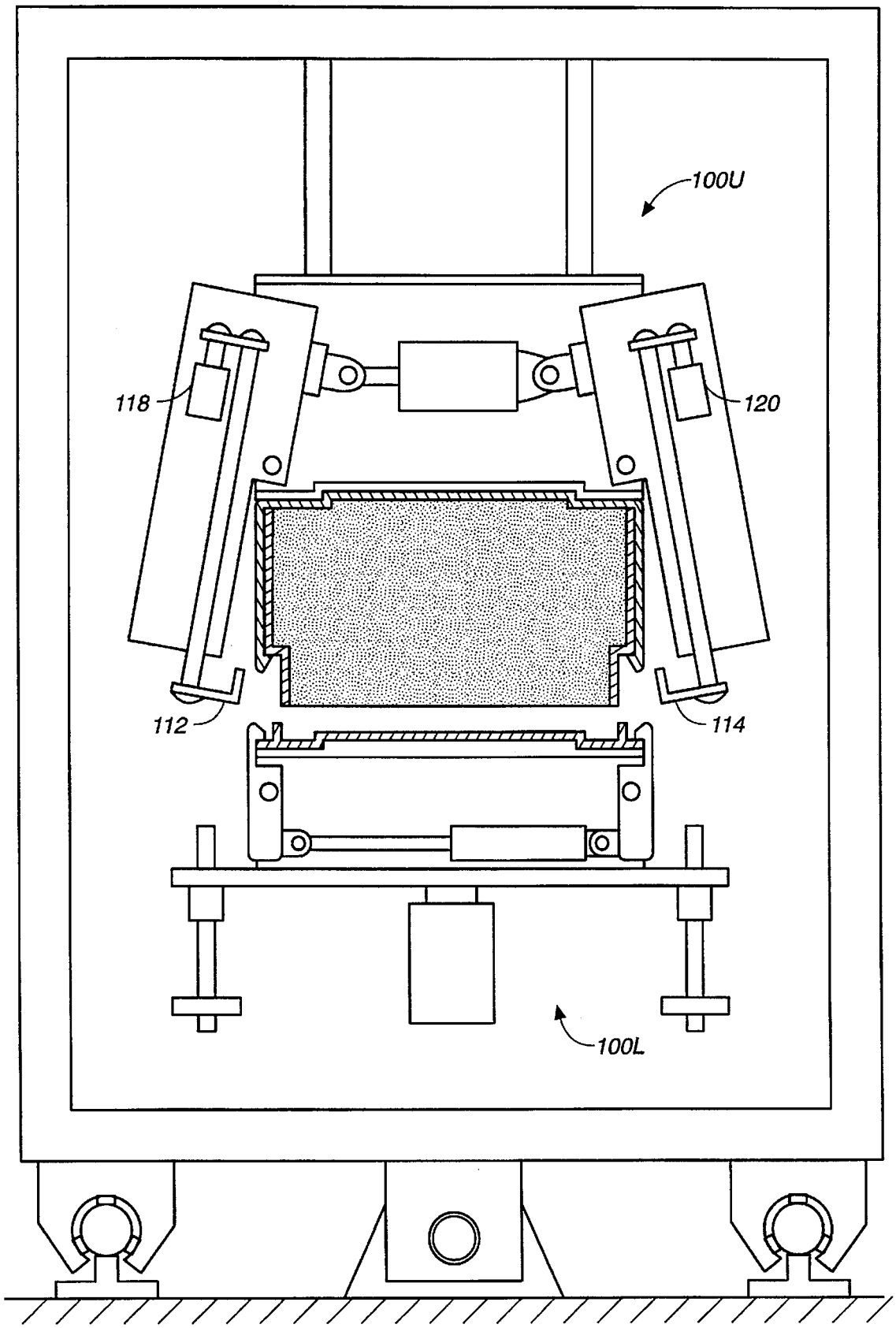

Referring to FIG. 4G, as soon as lower structure 100L is in its downward position, fingers 112, 114 of upper structure 100U are pushed downward by air cylinders 118, 120.

Figure 4H:
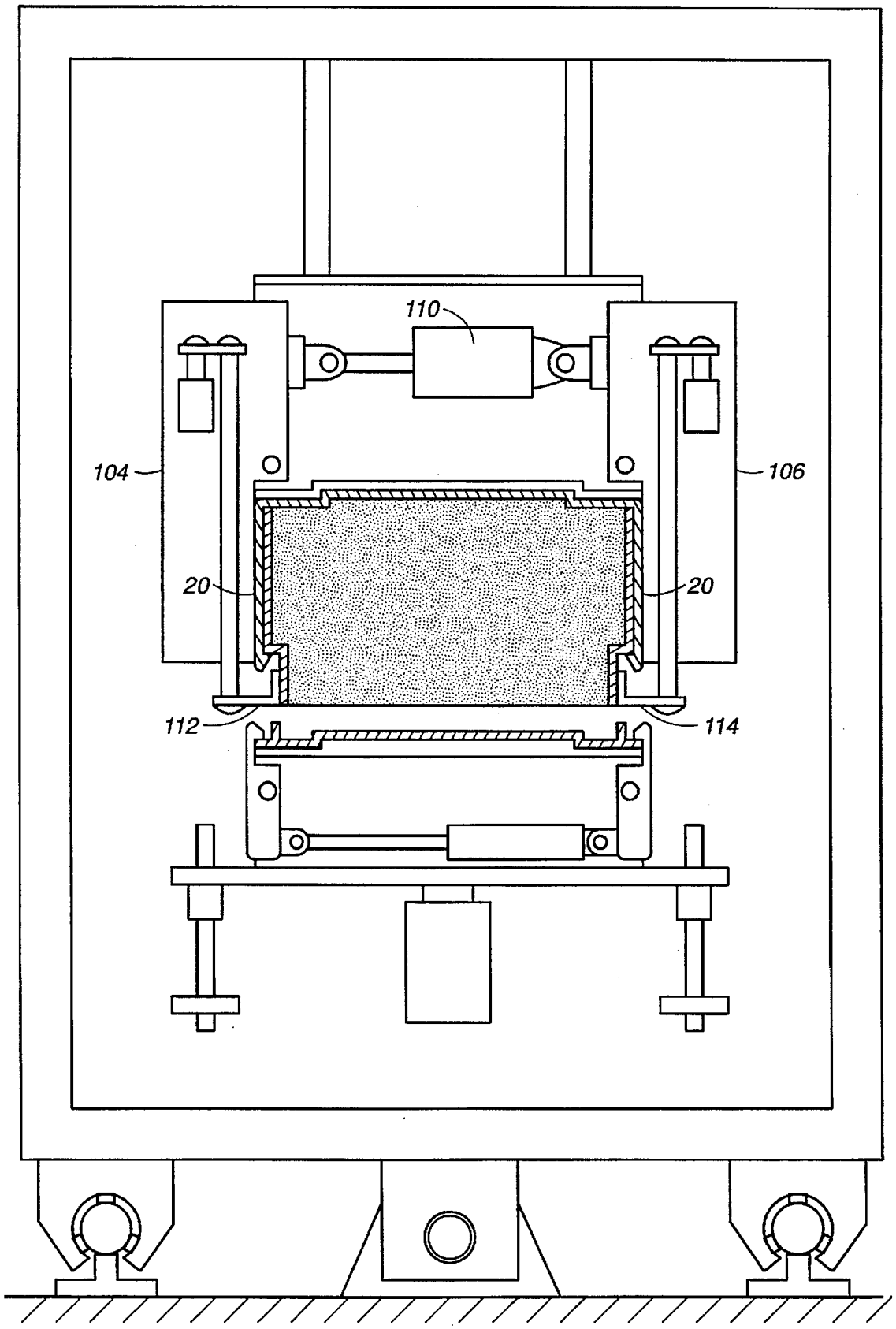

Referring to FIG. 4H, after fingers 112, 114 are extended to their lower position, arms 104, 106 are pushed into their inward position by air cylinder 110 so that fingers 112, 114 are moved underneath tongues 20.

Figure 4I:
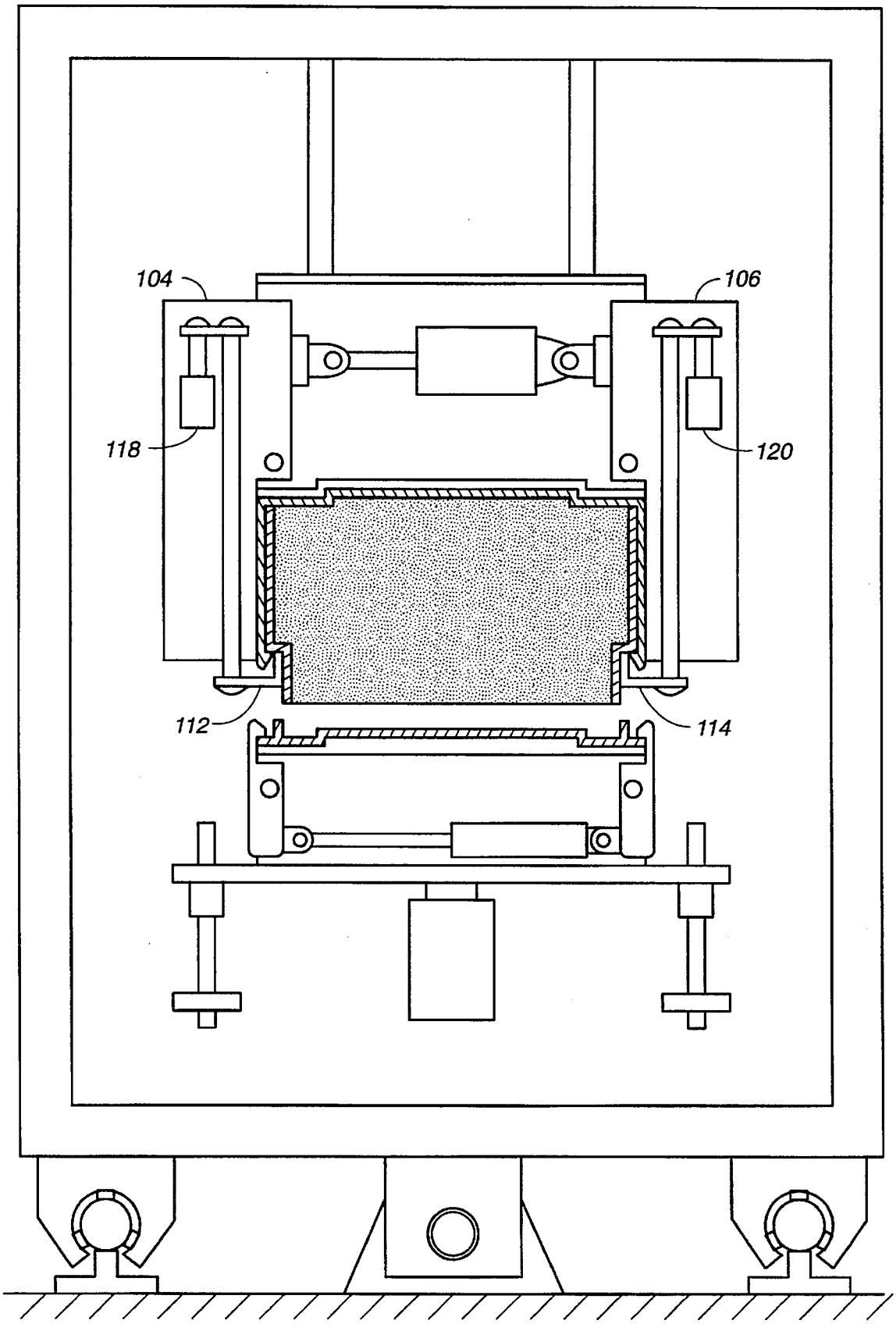

Referring to FIG. 4I, after arms 104, 106 are pushed into their inward position, fingers 112, 114 are pushed into their upward position by air cylinder 118, 120.

Figure 4J:
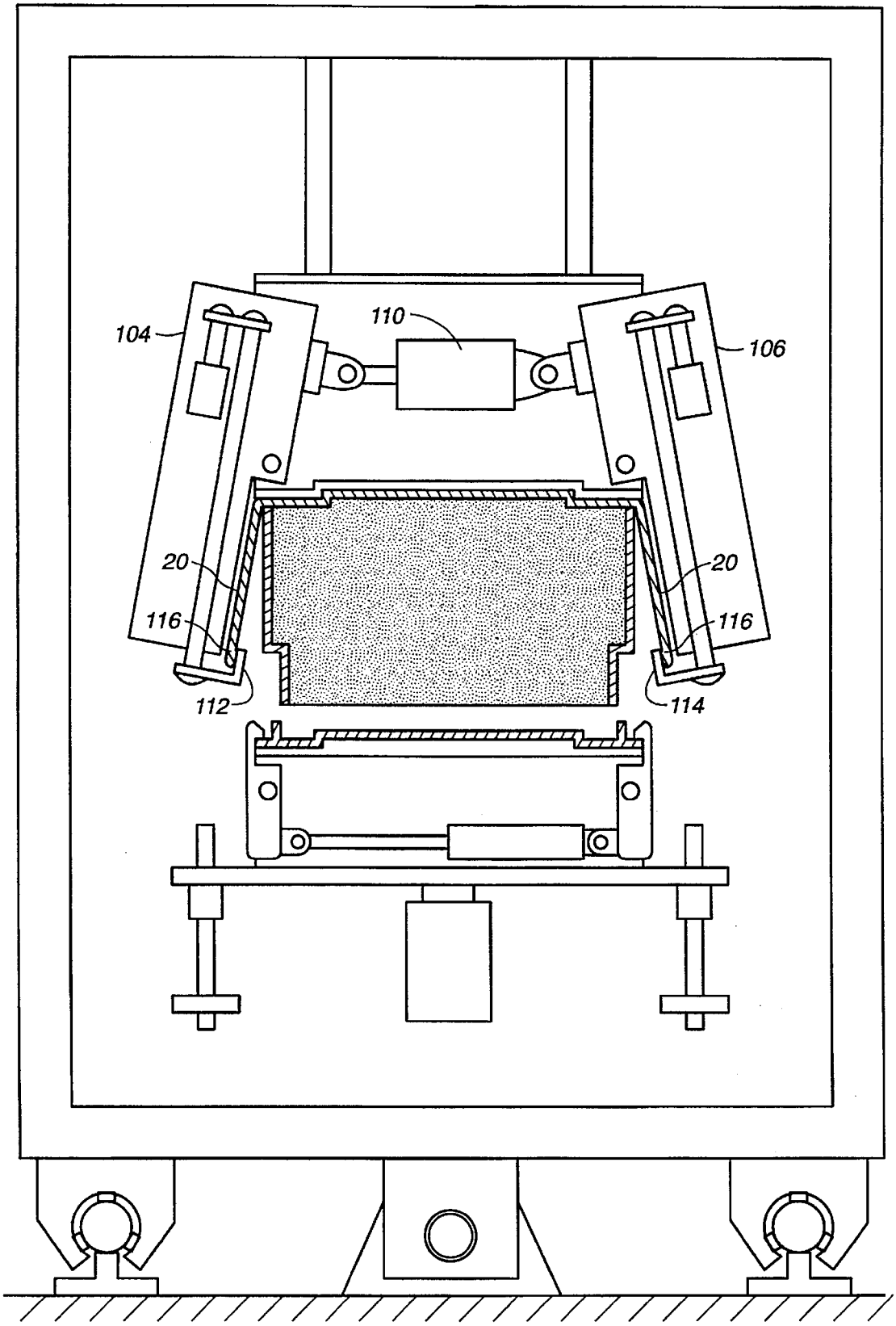

Referring to FIG. 4J, after fingers 112, 114 are pushed into their upward position, arms 104, 106 are pulled into their outward position by air cylinder 110. Of importance, fingers 112, 114 push rims 116 of tongues 20 outward when arms 104, 106 are pulled outward.

Figure 4K:
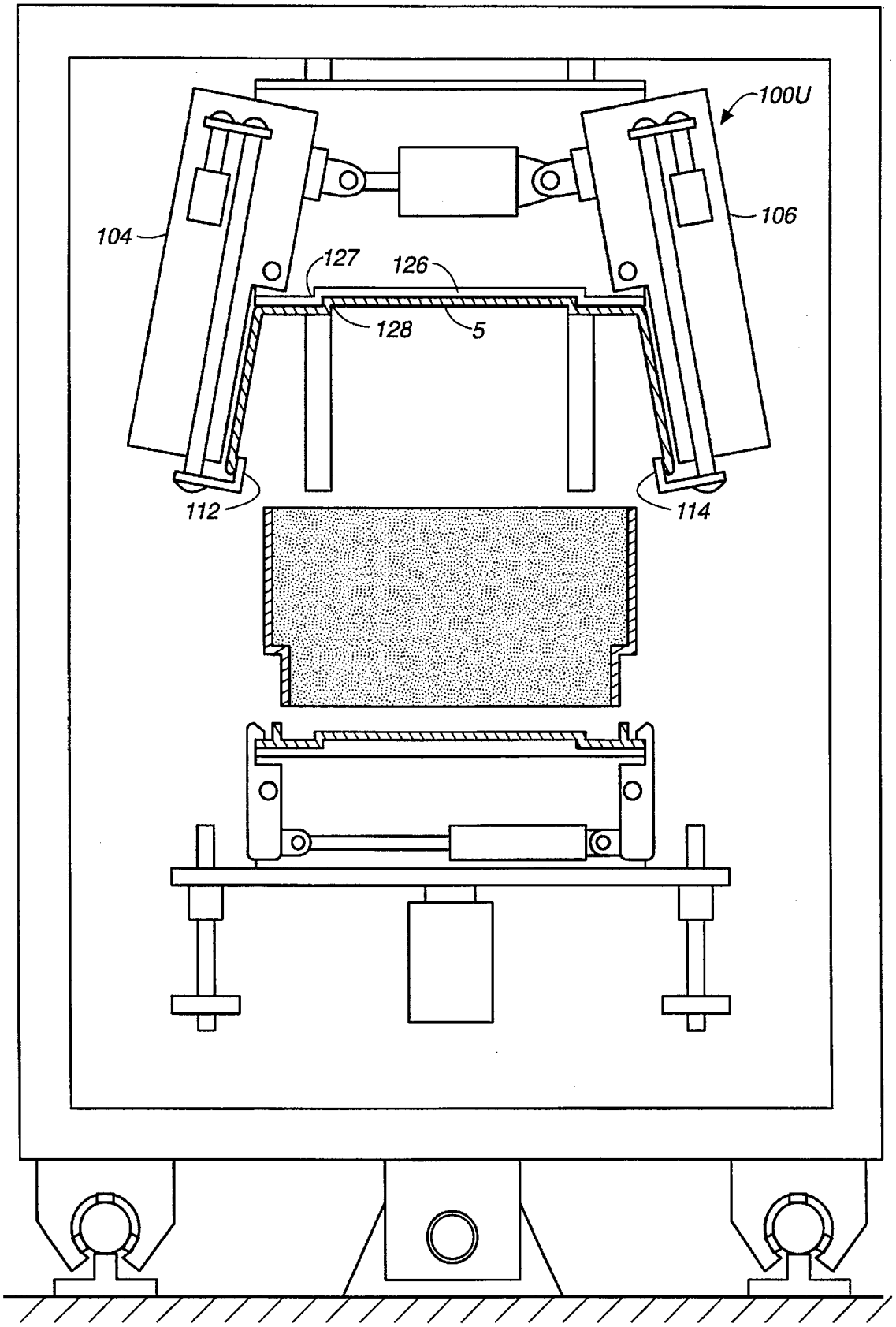
Figure 4L:
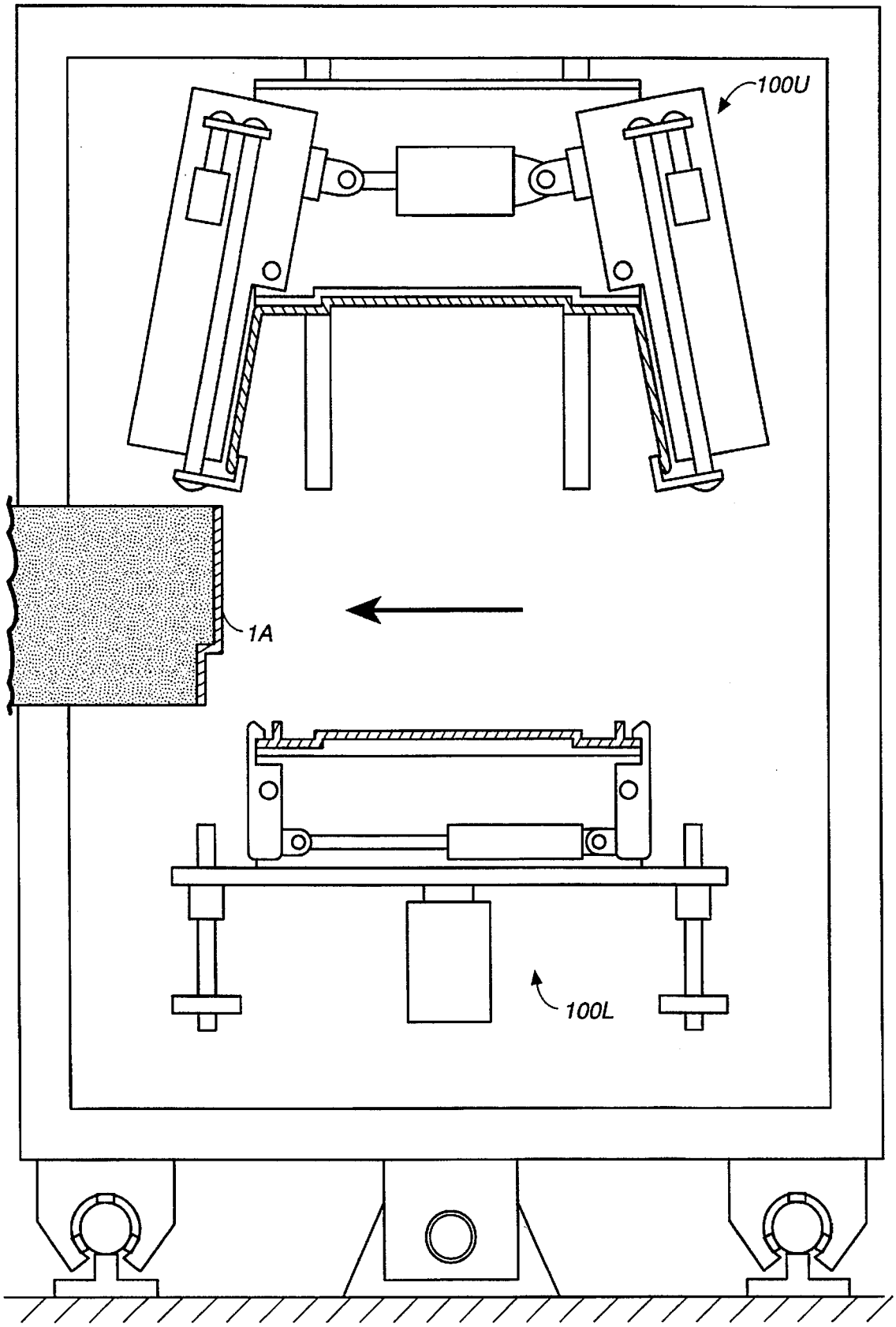

Referring to FIG. 4K, after arms 104, 106 are pulled outward, structure 100U is pushed upward by air cylinder 124 (cylinder 124 is not shown in FIG. 4K, but is shown in FIGS. 2 and 5). Upper cassette cover 5 is held in place by fingers 112, 114, which hold top cover 5 against the lower surface 126 of structure 100U. As mentioned above, lower surface 126 includes an indentation 127 which mates with projection 128 of cover 5, thereby helping to ensure that cover 5 is held in place.

After top and bottom covers 5, 8 are removed from the cassette, fingers 170–176 release cassette 1A, and bands CB7 move the cassette out of station 30 and bands CB5 move cassette 1A onto conveyer bands CB2 (FIGS. 2 and 3). As mentioned above, the cassette is then conveyed to a location where manufacturing steps can be performed on the disks within the cassette. The exact nature of this manufacturing step is not critical to our invention.

After the top and bottom covers are removed from the cassette and the cassette is conveyed away from station 30, frame 32 (and station 30 and structures 100U and 100L coupled thereto) is moved by air cylinder 38 so that the covers held by structures 100U, 100L can be placed onto another cassette conveyed into station 30 by conveyer bands CB6. The process by which the top and bottom covers 5, 8 are placed onto this cassette is essentially the opposite of the process by which the covers are removed. The process is as follows:

1. A stop 191 is moved in direction O (FIG. 6). The cassette is then moved into station 30 in direction L by bands CB6 and CB7.
2. When the cassette reaches sensor S2, the stepper motor driving bands CB7 slows. When the cassette reaches another sensor (not shown), the stepper motor overdrives bands CB7 by a short distance to ensure that the cassette is in position against mechanical stop 191, and then bands CB7 stop.
3. The cassette is gripped by fingers 170–176. Thereafter, stop 191 is moved out of the way (in a direction P).
4. Upper structure 100U (which is still carrying top cover 5 removed from the cassette shown in FIGS. 4A to 4L) is moved down onto the cassette by air cylinder 124. During this step, arms 104, 106 are in their outward position.
5. Arms 104, 106 of structure 100U are the moved inwardly.
6. Fingers 112, 114 are moved downward. At this point, top cover 5 is in place on the cassette. Note that this has been done without the "snap-back" of tongues 20 over catches 23.
7. Arms 104, 106 are pushed into their outward position by air cylinder 110.
8. Structure 100L is pushed upward by air cylinder 154. At this point, bottom cover 8 is in place on the cassette. Note that at this point structure 100U is in its downward position and braces the cassette so that it is not moved upward by structure 100L.
9. Arms 156, 158 (and therefore fingers 190, 192) are pushed outward by air cylinder 162.
10. Structure 100L is pushed downward by air cylinder 154.
11. Upper structure 100U is pushed upward by air cylinder 124.
12. Fingers 170–176 are retracted to release the cassette.
13. The cassette, with both top and bottom covers 5, 8 in place, is pushed out of station 30 by bands CB7 and is then moved away by conveyer bands CB3.
14. Frame 32 is then pushed by air cylinder 38 so that apparatus 100 can receive another cassette from conveyer bands CB1.

In other embodiments, the sequence of the above steps can be modified. For example, in one embodiment, the top and bottom covers are removed simultaneously, or placed on the cassette simultaneously. Similarly, the top cover can be removed before the bottom cover. Also, the bottom cover can be placed on the cassette before the top cover.

Apparatus 100 includes a set of sensors S3 and S4 for sensing the presence of cassettes on bands CB5 and CB6 (FIG. 3). Sensors S3 and S4 are typically fiber optic sensors such as device No. PZ2-62, available from Keyence Corporation of Woodcliff Lake, N.J. Sensors S1 to S2 (and the other sensors which sense the position of the cassette as it is moved by bands CB7) are typically device No. FS2-60, also available from Keyence Corporation. In addition, each air cylinder typically includes a position sensor (e.g. comprising a magnet and a Hall effect element). These sensors are each coupled to the PLC integrated circuit, which controls each of the air cylinders via the above-described solenoids, and each of the motors. The sensors within the various air cylinders are used by the PLC integrated circuit to control operation. For example, during step 3 above, the sensors within air cylinders 178–184 (which control fingers 170–176) indicate when cylinders 178–184 have been actuated (and thus when fingers 170–176 have grasped the cassette). The signals provided by cylinders 178–184 then cause the PLC integrated circuit to perform step 4 above (i.e. to actuate cylinder 124). The sensor signal from cylinder 124 causes the PLC integrated circuit to perform step 5, above, and so on.

Apparatus 100 also includes optical sensors (not shown) for sensing the presence or absence of covers 5 and 8. Thus, if apparatus 100 is to place covers on a cassette, and either structure 100U or 100L is not holding a cover, that will be sensed by a sensor, and communicated to the PLC integrated circuit, which will take appropriate action (e.g. actuating an appropriate indicator and halting operation). Similarly, if apparatus 100 is to remove covers from a cassette, but one of structures 100U, 100L is already holding a cover, that will be communicated to the PLC integrated circuit, which will then take appropriate action (e.g. actuating an appropriate indicator and halting operation). The sensors which indicate the presence or absence of covers can be optical sensors of the type discussed above.

Figure 7:
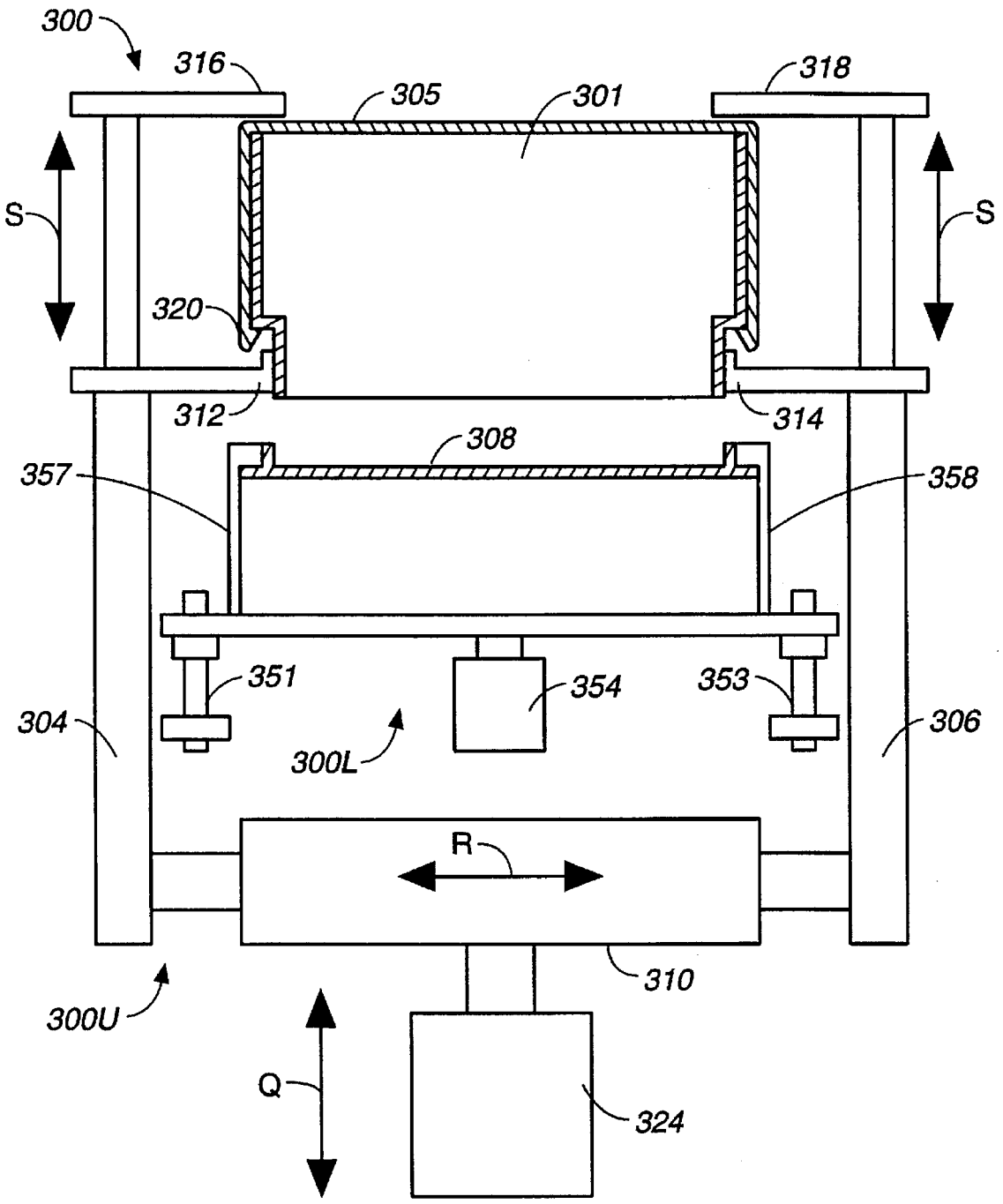
FIG. 7 schematically illustrates an alternative embodiment of apparatus for removing covers from cassettes.

FIG. 7 illustrates apparatus 300 in accordance with an alternative embodiment of the invention for removing covers 305, 308 from and placing covers on a cassette 301. Referring to FIG. 7, apparatus 300 includes lower cover removal structure 300L similar to structure 100L. Specifically, structure 300L is moved up or down by an air cylinder 354 along rails 351, 353. Similarly, structure 300L includes arms 357, 358 which can be moved inwardly or outwardly by an air cylinder (not shown) similar to air cylinder 162.

Apparatus 300 also includes a structure 300U for removing top cover 305, but in accordance with the alternative embodiment, the structures for actuating the various elements of structure 300U are located below cassette 301 and distant from cassette 301 (e.g. to minimize contaminant particle generation in the vicinity of the disks contained in cassette 301). In particular, structure 300U is moved up or down (see arrow Q) by an air cylinder 324. A pair of arms 304, 306 are moved inwardly or outwardly by an air cylinder 310 (see arrow R). Arms 304, 306 include a set of fingers 312, 314 for engaging with tongues 320 of top cover 305. Of importance, within arms 304, 306 are air cylinders for moving fingers 312, 314 up and down (see arrows S), and also moving a second set of fingers 316, 318 up or down. (Fingers 316, 318 help grasp top cover 305.)

While the invention has been described with respect to specific embodiments, those skilled in the art will recognize that changes can be made in form and detail without departing from the spirit and scope of the invention. For example, actuators other than air cylinders (e.g. stepper motors or other motors) can be used. In addition, the apparatus can be used in conjunction with cassettes that transport objects other than magnetic disks, e.g. semiconductor wafers or magneto-optic disks. While lower structure 100L contains a projection for mating with an indentation in bottom cover 8, in other embodiments, structure 100L has a indentation for mating with a projection in bottom cover 8. In like manner, upper structure 100U can have a projection for mating with an indentation in top cover 5. The various members and arms can be constructed from metal or any other appropriate material.

In one embodiment, central member 102, arms 104, 106 and structure 100L can have exhaust conduits for removing air (and any dust or particles or contaminants) therefrom.

In one embodiment, fingers 112, 114 can have curved surfaces (e.g. surface 112A in FIG. 2) for better coupling with tongue 20.

It should also be noted that while the structure of FIG. 2 includes conveyer bands CB1 to CB3, conveying structures other than conveying bands can be used in lieu thereof, e.g. robotic arms.

While apparatus 100 takes both top and bottom covers off of a cassette, in other embodiments, only one cover (either the top or bottom) is taken off or placed on a cassette.

In one embodiment, instead of using the apparatus to remove covers prior to a manufacturing step, the apparatus places covers onto a cassette immediately prior to a labelling operation in which a mark or label is applied to a side of the cassette. This is done because labelling can generate contaminant particles, and it is desirable to keep such particles away from disks contained in the cassette.

Other modifications will be apparent to one of ordinary skill in light of the foregoing, and all such modifications come within the present invention.

We claim:

1. Apparatus for removing or placing covers on a cassette, comprising:

a station for receiving a cassette;

an upper cover removal unit having a pair of upper arms, each arm within said pair of upper arms comprising means for grasping an upper cover and removing said upper cover from said cassette while said cassette is at said station;

a lower cover removal unit having a pair of lower arms, said lower arms comprising means for grasping and removing a lower cover from said cassette while said cassette is at said station;

first means for moving said upper cover removal unit toward or away from said cassette while said cassette is at said station;

second means for moving said lower cover removal unit toward or away from said cassette while said cassette is at said station; and third means for moving said upper and lower cover removal units in a direction such that said upper and lower cover removal units remain aligned with each other when said upper and lower cover removal units are moved in said direction.

2. Structure of claim 1 wherein said first, second and third means are air cylinders.

3. Structure of claim 1 wherein said upper arms each comprise at least one finger and fourth means for moving said finger so that said finger can be moved underneath a rim of said top cover, said upper cover removal structure further comprising fifth means for moving said upper pair of arms outward.

4. Structure of claim 3 wherein said fourth and fifth means are air cylinders.

5. Structure for placing a cover on a cassette, said cassette having a first rim, said cover having a side including a catch on said side for engaging with said first rim, said side of said cover having a second rim, said structure comprising:

an arm having at least one finger thereon for engaging with said second rim;

first means for moving said arm toward or away from said cassette, whereby when said arm is moved toward or away from said cassette, said finger is moved toward or away from said cassette, and when said finger engages with said second rim, said side of said cover can be moved toward or away from said cassette;

whereby when said structure places said cover on said cassette, said side of said cover is held away from said cassette until said catch passes said first rim.

6. Structure of claim 5 wherein said first means is an air cylinders.

7. Structure of claim 6 further comprising second means for moving said finger along an axis substantially parallel to said arm so that said finger can engage with or disengage from said second rim.

8. Structure of claim 7 wherein said second means is an air cylinder.

9. Structure of claim 8 further comprising an electronic controller for controlling said first and second means so that said first and second means cause said finger to pull said side of said cover away from said cassette when said cover is placed on said cassette.

10. Structure of claim 9 wherein said electronic controller is an integrated circuit.

11. A method for placing a cover on a cassette, said cassette having a rim, a catch for engaging with said rim being on a side of said cover, said side of said cover having a rim, said method comprising the steps of:

causing said rim of said side of said cover to be held by a cover grasping structure;

pulling said cover grasping structure away from said cassette;

causing said cover grasping structure to push said cover onto said cassette; and thereafter pushing said cover grasping structure toward said cassette so that said catch engages said rim.

12. Method of claim 11 wherein performing said step of pulling prior to said step of causing said cover grasping structure to push said cover onto said cassette prevents said side of said cover from snapping over said catch and generating contaminant particles.

13. Method of claim 11 wherein said step of pushing and pulling is performed by actuating an air cylinder.

14. Structure for removing a cover comprising:

a first central member;

a first set of arms coupled to said first central member, said first set of arms further comprising means for engaging with and removing a cover from a cassette, said arms forming at least some of the walls of said central member; and means within said first central member for pulling and pushing said arms.

15. Structure of claim 14 wherein said means within said central member for pushing and pulling said arms is an air cylinder, and said arms are pivotally coupled to said central member.

16. Structure of claim 14 further comprising an air intake for removing air from the interior of said central member, to thereby remove contaminants from said structure.

17. Structure of claim 14 wherein a wall of said central member comprises an indentation for mating with a wall of said cover.

18. Structure of claim 14 wherein said structure removes a top cover from a cassette, said structure further comprising a bottom cover removal structure comprising a second central member and a second set of arms, said second set of arms serving as part of the walls of said second central member, said second central member including means for pushing and pulling said second pair of arms, said second pair of arms comprising means for grasping said bottom cover.

19. Structure of claim 18 wherein said means for pushing and pulling said second pair of arms is an air cylinder and said second central member comprises an air intake for removing air from said second central member to thereby remove contaminants from said structure.

20. Structure of claim 14 wherein said structure removes a bottom cover from a cassette.

* * * * *